US007146655B2

(12) United States Patent
Karnopp et al.

(10) Patent No.: US 7,146,655 B2
(45) **Date of Patent: *Dec. 12, 2006**

(54) BARIATRIC TOILET SEAT SUPPORT APPARATUS

(75) Inventors: Gordon J. Karnopp, Green Bay, WI (US); David F. Burkart, Little Suamico, WI (US)

(73) Assignee: DB Industries LLC, Little Suamico, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/057,793

(22) Filed: Feb. 14, 2005

(65) Prior Publication Data

US 2005/0183193 A1 Aug. 25, 2005

Related U.S. Application Data

(63) Continuation-in-part of application No. 10/454,869, filed on Jun. 5, 2003, now Pat. No. 6,889,392.

(51) Int. Cl.
*E03D 11/00* (2006.01)

(52) U.S. Cl. ..... 4/254; 4/239

(58) Field of Classification Search ..... 4/254, 4/239, 246.1, 246.4, 246.5, 667; 297/452.18, 297/338; 248/346.01, 188.1
See application file for complete search history.

(56) References Cited

U.S. PATENT DOCUMENTS 2,903,714 A 9/1959 Grondona
3,047,884 A 8/1962 Grondona
3,905,051 A * 9/1975 Gozdziewski ..... 4/661
4,168,552 A * 9/1979 Austin ..... 4/254
4,587,678 A * 5/1986 Love et al. ..... 4/254
5,150,480 A 9/1992 Schmucki
5,210,883 A 5/1993 Weber et al.
5,289,596 A 3/1994 Rose et al.
5,309,583 A 5/1994 White et al.
5,341,517 A 8/1994 Bly
5,737,780 A * 4/1998 Okita et al. ..... 4/254
5,933,877 A 8/1999 Wu
6,000,068 A 12/1999 Chavis
6,199,228 B1 3/2001 Kallweit
6,256,800 B1 7/2001 Isbit
6,324,705 B1 12/2001 Zephler

* cited by examiner

*Primary Examiner*—Khoa D. Huynh
(74) *Attorney, Agent, or Firm*—Andrus, Sceales, Starke & Sawall, LLP

(57) ABSTRACT

A bariatric toilet seat support apparatus for a conventional toilet is disclosed herein. The bariatric toilet seat support apparatus is designed to be placed under a toilet seat such that when an individual uses the toilet seat the weight of the individual is transferred from the toilet seat to the support apparatus of the current invention, avoiding distribution of weight to the toilet itself. The bariatric toilet seat support apparatus of the current invention may be used with floor mounted or wall mounted toilets. It is designed to prevent wall mounted toilets from breaking off the wall under the weight of an individual and also to prevent floor mounted toilets from collapsing under the weight of an individual.

13 Claims, 4 Drawing Sheets

BARIATRIC TOILET SEAT SUPPORT APPARATUS

The present application is a continuation-in-part of application Ser. No. 10/454,869 filed Jun. 5, 2003, and which will issue as U.S. Pat. No. 6,889,392 on May 10, 2005.

BACKGROUND OF THE INVENTION

The current invention relates to toilet supports, more particularly to toilet seat supports for floor or wall mounted toilets, and most particularly to toilet seat supports for bariatric individuals using floor mounted or wall mounted toilets. The invention is designed for use in many diverse environments, particularly in hospital, nursing homes or other institutional environments. One of skill in the art will recognize that the invention may be beneficial in hospital environments for obese patients, as well as in orthopedic and labor and delivery units.

Toilets manufactured in the United States are currently rated to support approximately 300 lbs. However, the population of this country is getting larger and larger with each passing year.

The vitreous china or porcelain that both wall mounted and floor mounted toilets are constructed of is incapable of supporting bariatric (i.e. overweight) individuals. Conventional toilets have a seat designed to receive the weight of an individual using the toilet. The weight of an individual is distributed onto the toilet when in use. When a bariatric individual using a toilet exceeds the toilet support capacity, significant problems may occur.

Many hospitals and other institutions have had problems with wall mounted toilets breaking off the wall due to the weight of bariatric individuals. Further, floor mounted toilets have been known to collapse under the weight of bariatric individuals. Such individuals may receive serious injuries when a toilet collapses beneath them, including, lacerations to the buttocks, thighs, and back. Further, the discomfort and embarrassment of toilet collapse victims should not be underestimated.

U.S. Pat. No. 2,903,714 to Grondona discloses an assistance aid to assist a user in moving to and from a toilet seat. The '714 patent includes four members with non-adjustable, non-slip bottom surfaces adapted to engage a floor. The '714 patent further discloses clip members (21, 22) disposed underneath the toilet seat for proper positioning of the frame. Significantly, the '714 patent is directed to aiding persons who, due to illness, injury, loss of limbs or other infirmity, require assistance in lowering their body weight onto a toilet seat, and raising themselves therefrom. The '714 patent does not discuss nor in any way indicate that the invention may be used to relieve the weight of a user off of a toilet and onto the support frame, thereby preventing damage to the toilet and injury to the user.

U.S. Pat. No. 3,047,884 to Grondona is also directed to a body assist for a person to aid and guide the user in moving to and from a toilet seat. The apparatus includes a frame that is positionable on a floor surface and members (23, 51, 52) that attach the frame to the toilet. The members are fixedly positioned in contact with the toilet seat and the toilet bowl, and does not disperse the weight of the user from the toilet to the frame because the frame is fixedly attached to the toilet. Thus, when a user applies weight to the toilet seat, the weight is not relieved from the toilet. Accordingly, like the '714 patent, discussed above, the '884 patent is directed to aiding persons who, due to illness, injury, loss of limbs or other infirmity, require assistance in lowering their body onto a toilet seat, and raising themselves therefrom, rather than distributing the weight of a user off of a toilet and onto a frame, thereby preventing damage to the toilet and the user.

U.S. Pat. No. 6,256,800 to Isbit discloses a toilet accessory that fits over a standard toilet having a cut-out to allow a person to use the toilet in a squatting position. The toilet accessory of the '800 patent is designed to replace the toilet seat of the toilet it is intended to be used with. The accessory of the '800 patent does not allow the toilet seat 18 of the toilet to be used, and particularly does not allow the toilet seat to rest on the accessory.

Accordingly, there is a need for a support apparatus that will support the toilet seat of a toilet and relieve the toilet from the weight of an individual.

SUMMARY OF THE INVENTION

The current invention provides a bariatric toilet seat support apparatus for use with a floor mounted or wall mounted toilet. Conventional toilets have a seat for receiving the body of a user. The seat transfers the user's weight to the toilet. The bariatric toilet seat support apparatus of the current invention comprises a weight distributing frame positionable on a floor surface and a pair of toilet seat support members attached to the frame. The toilet seat support members are suitable to be positioned under the toilet seat to receive the weight of the user so that the weight of the user is distributed onto the weight distributing frame. Thus, the weight of the individual is relieved from the toilet, and transferred to the floor.

In one embodiment of the invention, the bariatric toilet seat support apparatus of the current invention has base members removably attached to the frame for engaging the floor surface. Preferably, the base members have a means for adjusting the height of the support apparatus, a means for leveling the support apparatus, and a non-slip bottom surface. The means for adjusting the height of the support apparatus is adjustable to position the seat support members at a proper height to receive the weight of a user.

In another embodiment, the bariatric toilet seat support apparatus includes a pair of adjustable wall locator members engageable with a wall proximate to the toilet. The wall locator members are adjustable to position the seat support members at a proper location between the toilet seat and the toilet to receive the weight of the user.

In another embodiment, the bariatric toilet seat support apparatus of the current invention includes both the aforementioned adjustable base members and the aforementioned adjustable wall locator members. In this embodiment, both the adjustable base members and the adjustable wall locator members adjust to position the seat support members at the proper location related to the toilet to receive the weight of a user when the bariatric seat support apparatus of the current invention is in use.

The seat support members of the bariatric toilet seat support apparatus of the current invention have a thickness such that the support members may be placed between a toilet seat and a toilet bowl such that the toilet seat rests substantially along the support members. The weight distributing frame is fixedly attached along the outside edges of the bottom surface of the respective toilet seat support members. Thus, the toilet seat support members of the bariatric toilet seat support apparatus of the current invention may be placed between the toilet seat and a toilet bowl such that the toilet seat rests in a substantially parallel manner on the top surfaces of the respective support members. Further, with the embodiments including the adjustable base members and the adjustable wall locator members, the position of the seat support members will be advantageously positioned under the toilet seat to receive the weight of the user so that the weight is distributed onto the frame and relieved from the toilet.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
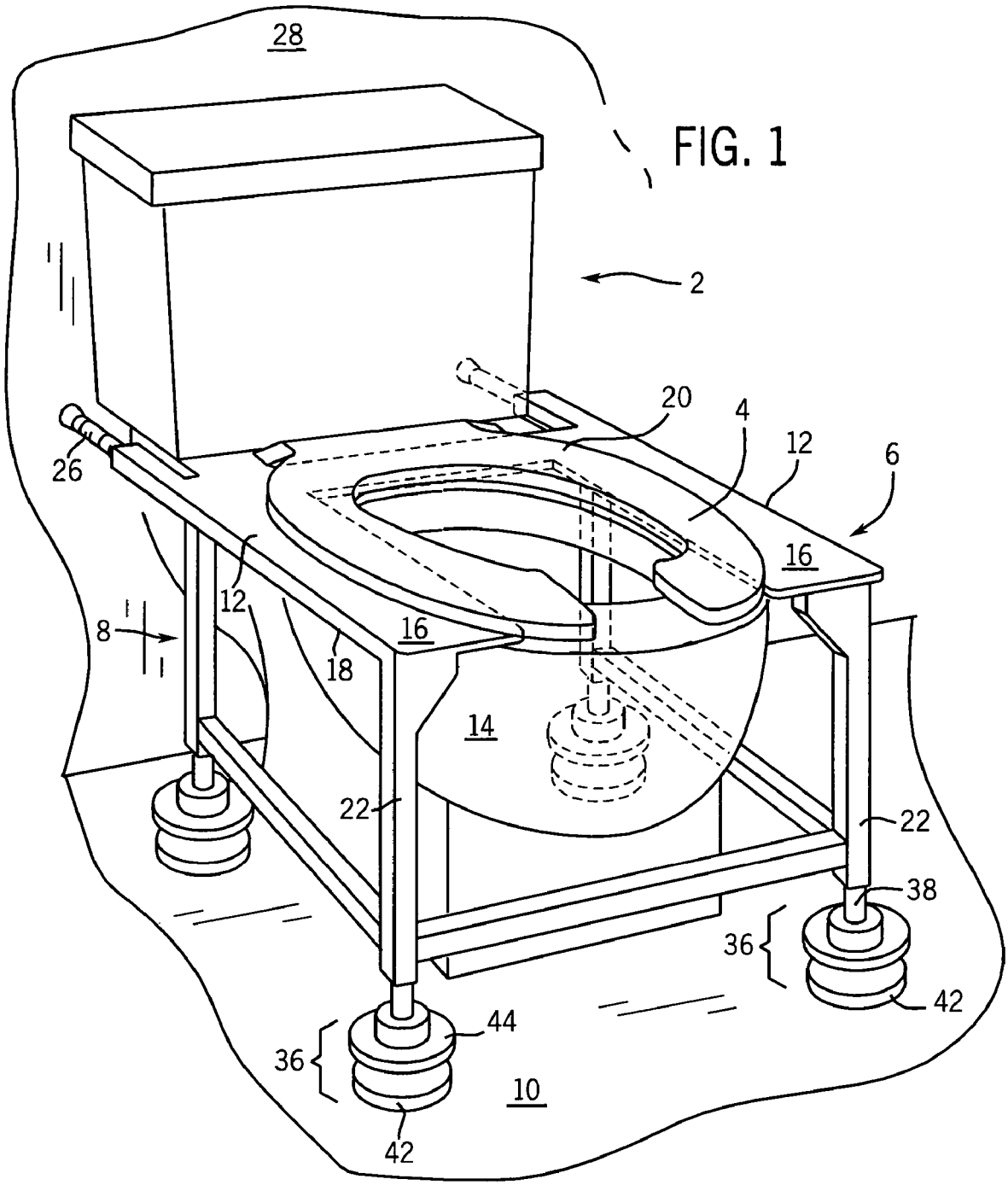
FIG. 1 is a perspective view of the new bariatric toilet support apparatus according to the current invention shown in use with a floor mounted toilet.
Figure 2:
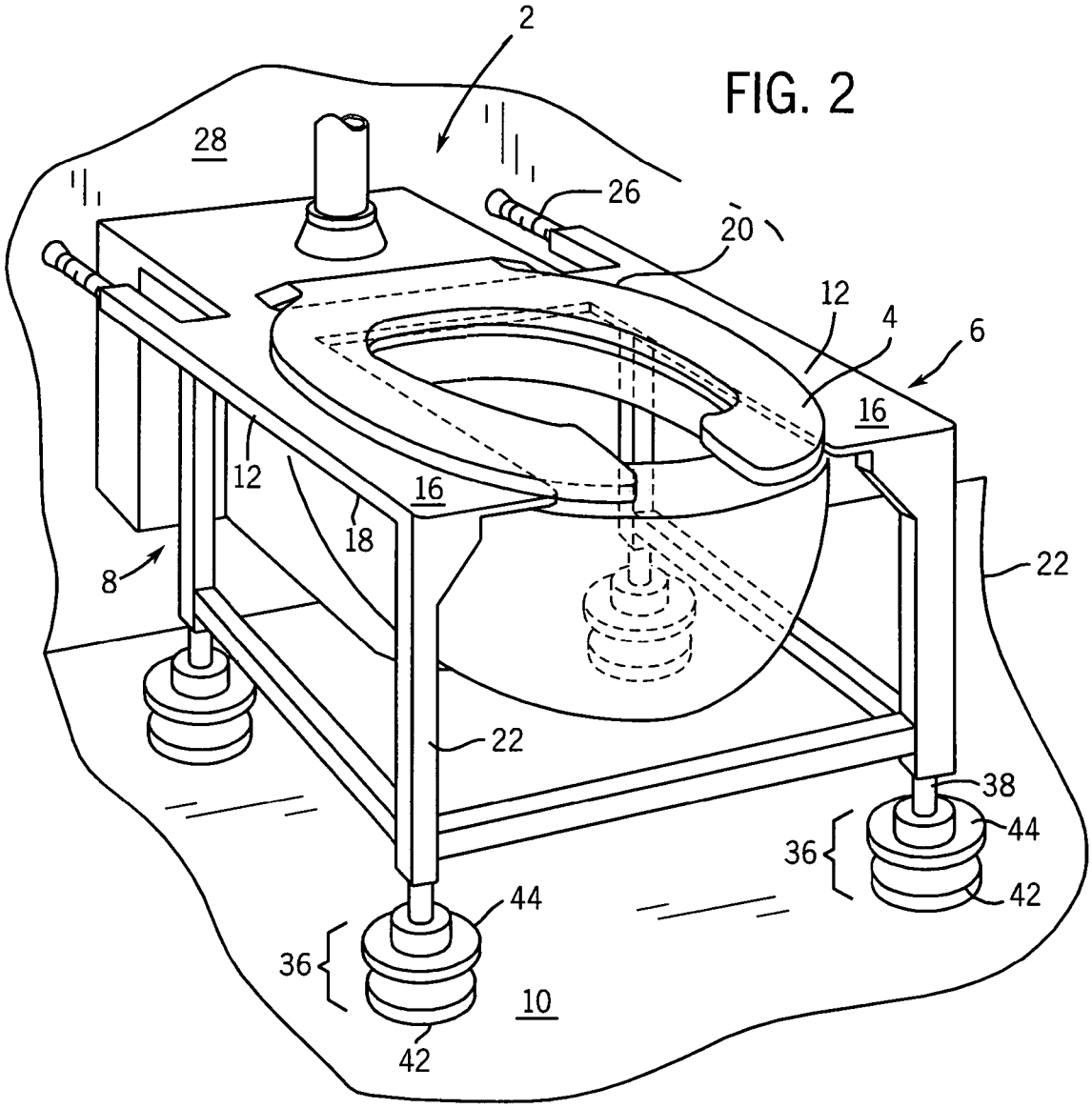
FIG. 2 is a perspective view of the new bariatric toilet seat support apparatus of the current invention shown in use with a wall mounted toilet.

With reference now to the drawings, FIG. 1 shows the bariatric toilet seat support apparatus 6 in use with a floor mounted toilet 2. Similarly, FIG. 2 shows the bariatric toilet seat support apparatus 6 in use with a wall mounted toilet 2. Referring now to both FIG. 1 and FIG. 2, the bariatric toilet seat support apparatus of the current invention can be designed for use with any conventional toilet 2. The toilet 2 may be either floor mounted, as demonstrated in FIG. 1, or wall mounted, as demonstrated in FIG. 2. The toilet 2 has a seat 4. The seat 4 receives a portion of the body of a user, thus the seat receives the weight of the user.

The bariatric toilet seat support apparatus 6 is comprised of a weight distributing frame 8 positionable on a floor surface 10, and a pair of toilet seat support members 12 are integral to the frame 8. Alternatively, the toilet seat support members 12 may be attached to the frame 8, preferably by welding, but may be attached using any other conventional means.

Preferably, the bariatric toilet seat support apparatus 6 is constructed of stainless steel. However, one of skill in the art will recognize that other material may be used to construct the apparatus. For example, and without limitation, the bariatric toilet seat support apparatus may be constructed of aluminum, carbon fiber, plastic, titanium or similar weight-bearing materials, or a combination thereof. Preferably, the support apparatus 6 is powder coated to prevent rusting or other deterioration of the material.

Figure 3:
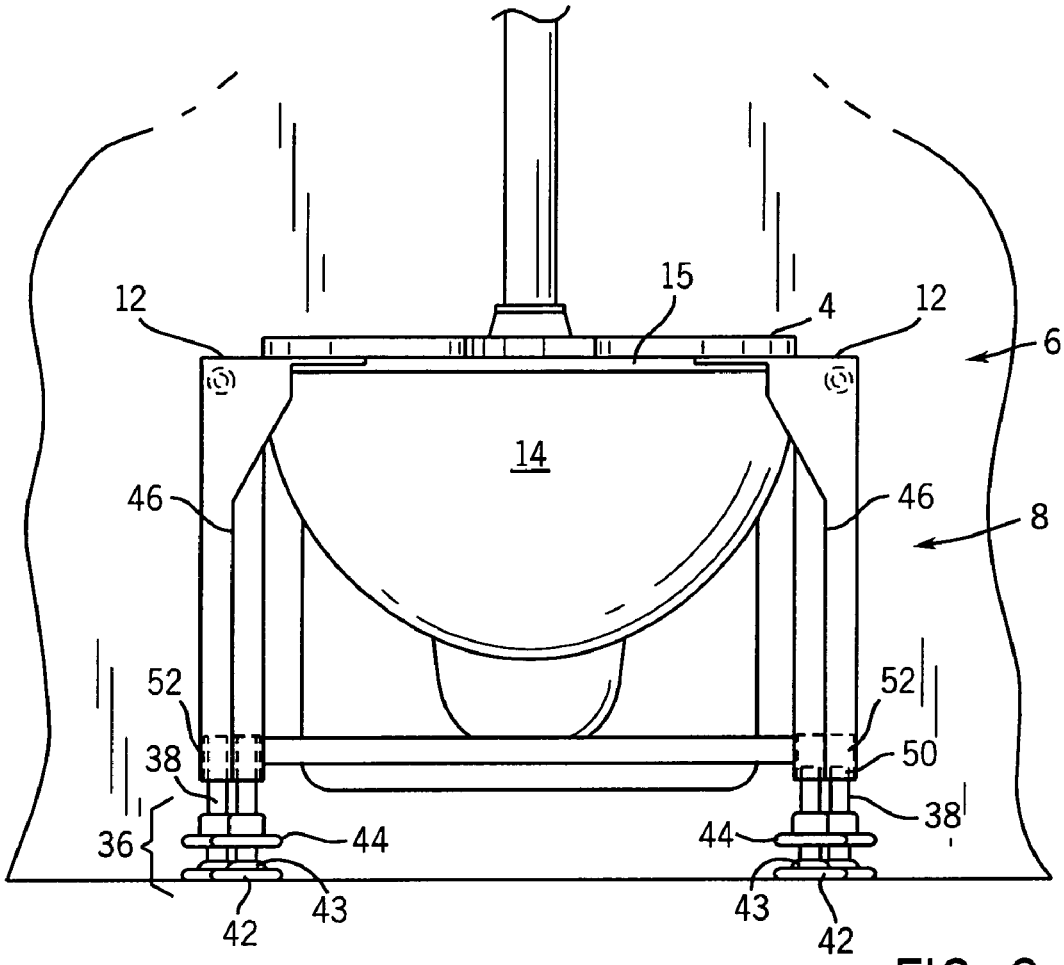
FIG. 3 is a front view of the present invention.
Figure 5:
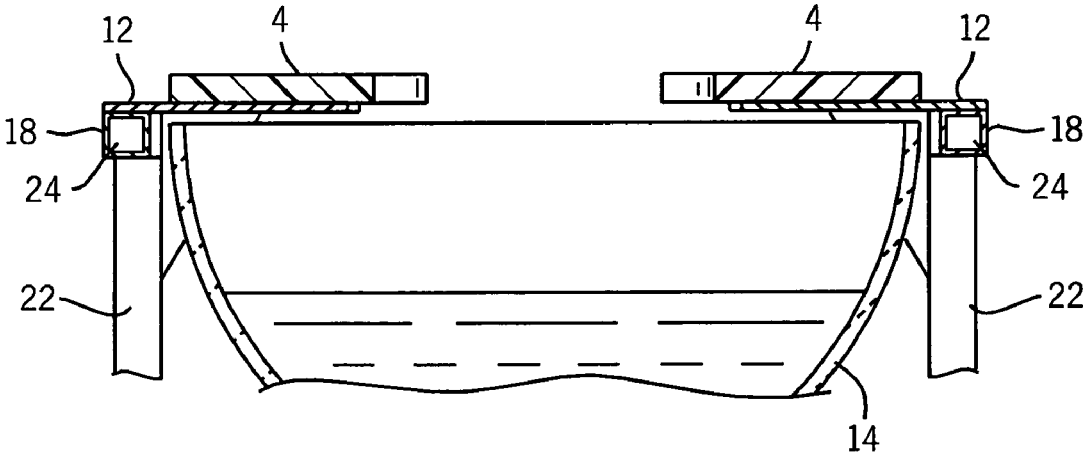
FIG. 5 is a sectional view of the present invention taken along line 5—5 of FIG. 4.
Figure 4:
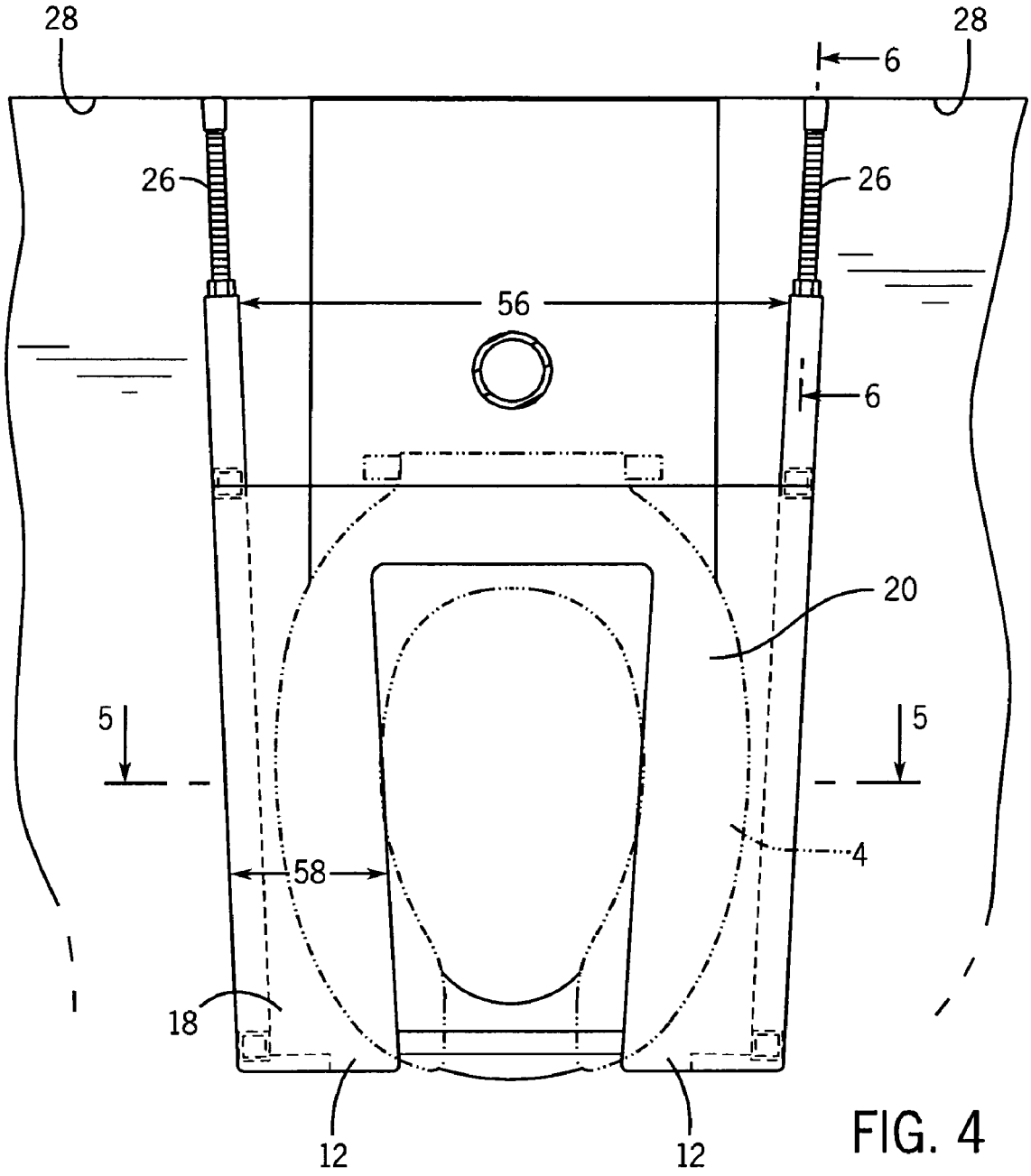
FIG. 4 is a top view of the present invention.

The toilet seat support members 12 are of a thickness such that the support members 12 may be placed between the toilet seat 4 and a toilet bowl 14 of a toilet 2. FIGS. 3, 4 and 5, in addition to FIGS. 1 and 2, demonstrate this arrangement. Although FIGS. 3, 4 and 5 demonstrate the support apparatus 6 in conjunction with a wall mounted toilet, it is understood that the apparatus may be used in the same manner with a floor mounted toilet.

The bariatric toilet seat support apparatus 6 is designed such that the toilet seat 4 rests on top surfaces 16 of the support members 12, rather than on a top surface 15 of the toilet bowl. Often toilet seats 4 have support knobs (not shown) on the bottom surface of the toilet seat 4 for engaging the top surface of the toilet bowl 15. With the present invention, the toilet seat 4 is capable of being raised from or lowered onto top surfaces 16 of the support members 12, and if support knobs exist on the toilet seats, the current invention is designed such that the knobs rest on the top surfaces 16 of the support members 12. Thus, the support members 12 are suitable to be positioned under the toilet seat 4 to receive the weight of the user so that the weight is distributed onto the frame 8 and relieved from the toilet bowl 14.

With reference now to FIGS. 1, 2, 4 and 6, the weight distributing frame 8 preferably has several components that provide the advantage of redistributing a user's weight from a toilet to the support apparatus of the present invention. A pair of support member braces 18 are located parallel with the toilet seat support members 12, and at least four post members 22 are positioned perpendicular to the support member braces 18 to engage the floor surface 10. Preferably, the toilet seat support members 12, the support member braces 18, the post members 22 and a back plate brace 20 integral with the support members 12 are of a unitary construction, for durability and ease of construction. Alternatively, the support member braces 18 may be attached in a parallel fashion along the outside edges of the bottom surfaces of the respective toilet seat support members 12, preferably by welding. The back plate brace 20, in this alternative embodiment, is attached to and extends between the support member braces 18 and is located perpendicular to the back edges of the support members 12, while the post members 22 are attached to the support member braces 18, preferably by welding, and are adapted to engage the floor surface 10. In the alternative embodiment, the weight distributing frame 8 includes angled braces 46 attached to post members 22. A first pair of angle braces 46 is attached to the front post members 22 and to the lower surfaces of the support members 12. The second pair of angle braces 46 is attached to the back post members 22 and the lower surface of the back plate brace 20. In this manner, the angle braces 46 provide additional support to the support members 12 and to add overall strength to the support apparatus 6. The frame is secured and/or constructed preferably by welding, however, the frame may be assembled using other conventional means which will accomplish the weight distributing function of the frame 8.

Figure 6:
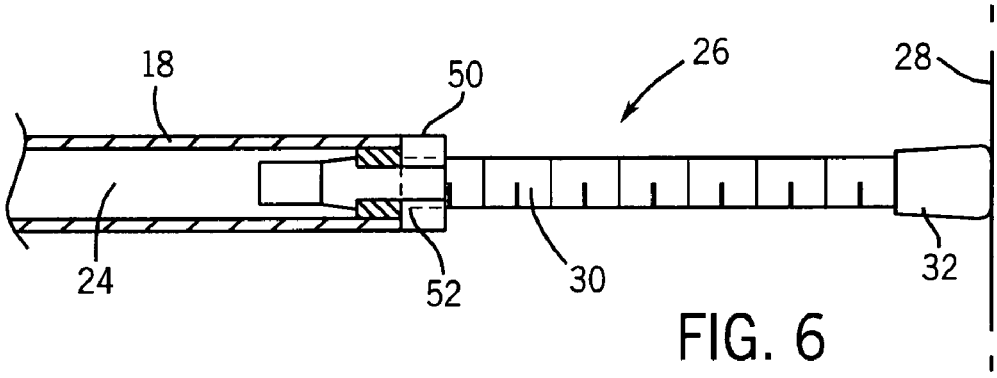
FIG. 6 is a sectional view of a support member of the present invention taken along line 6 of FIG. 4.

Referring now to FIGS. 4 and 6, in the preferred embodiment of the current invention, the support member braces 18 and the post members 22 contain a weight bearing, threaded tube insert 50 to allow for attachment of threaded attachments such as wall location members 26 or adjustable base members 36. The threaded tube insert 50 is placed in the braces 18 or post members 26 and fixedly secured such that a threaded bore 52 is accessible. Accordingly, the support member braces 18 are adapted to receive adjustable wall locator members 26. The adjustable wall locator members 26 engage the bore 52 of the threaded tube insert 50. The adjustable wall locator members 26 are adjusted to engage a wall 28 proximate to the toilet. The wall locator members 26 are further adjustable to position the seat support members 12 at a proper location so that the seat support members 12 are properly positioned to engage the toilet seat 4 and receive the weight of the user. As demonstrated in FIGS. 4 and 6, the adjustable wall locator members 26 are preferably constructed of a threaded rod 30 having a rubber stopper 32 attached to the end of the rod adapted to engage a wall 28.

The threaded tube insert 50 most preferably comprises a stainless steel member adapted to engage the threaded rod 30 wherein the member comprises a cylindrical upper portion and a generally cuboid lower portion, with a threaded bore passing therethrough. The cuboid lower portion is designed to be fixedly attached to the inner surface of the member into which it is placed. Alternatively, the threaded rod 30 may directly engage a bore otherwise displaced in the interior area 24 of brace 18 or a nut may be displaced in the interior area 24 to engage the threaded rod 30. The adjustable wall locator members preferably further include a locking nut 34 to maintain the proper position of the support apparatus 6 when in use. It will be appreciated by one of skill in the art that other embodiments of adjustable wall locator members exist, including slidably adjustable wall locator members, locking lever adjustable wall locator members, and the like.

Referring now to FIGS. 1, 2 and 3, the bariatric toilet seat support apparatus 6 of the current invention may further comprise adjustable base members 36 adapted to engage the floor surface 10. The base members 36 may be removably attached to the frame 8. Preferably, the base members 36 are removably threaded to threaded tube inserts 50 fixedly attached within the post members 22 of the weight distributing frame 8. The threaded tube insert 50 is also shown in FIG. 6 in conjunction with wall locator member 26. The adjustable base members 36 comprise height adjustment members for changing the height of the support frame 8 relative to a particular toilet. In the preferred embodiment, the height adjustment members of the support frame 8 comprise a threaded rod 38 adapted to engage a bore 52 in a threaded tube insert placed in the respective post members 22. Alternatively, the threaded rod 38 may directly engage a bore formed in the inner surface of the post members 22. As the threaded rod 38 is adjusted relative to the post member 22, the height of respective post members 22 is adjusted. In this manner, the height of the support apparatus 6 can be modified to fit toilets of varying heights and may also be adjusted to account for sloping or uneven floors. Preferably, the height of the support apparatus 6 is adjusted such that the support members 12, the toilet seat 4 and the top surface of the toilet bowl 15, are substantially parallel to one another when the toilet seat 4 is in a lowered position.

The adjustable base members 36 further comprise a floor member 42 adapted to engage the floor surface 10. The floor member has a non-slip bottom surface, preferably of neoprene. The adjustable base members further comprise a means for leveling coupled to the floor member 42 and engaging the adjusting means. The leveling means is adapted to adjust for uneven floors. Preferably, the leveling means comprises threaded rod 38 coupled to the floor member 42 by swivel bolt 43. In the most preferred embodiment, the adjustable base members are stainless steel based swivel leveling mounts available from WT Hight of Weymouth, Mass. The most preferred embodiment further comprises knurled lock nuts 44 to lock the adjustable base members 36 in place. The knurled lock nuts 44 are available from Endries International, Inc., Milwaukee, Wis.

Referring to FIGS. 1, 2 and 4, it is recognized by those with skill in the art that conventional toilets vary their dimensions depending upon the manufacturer of the toilet. The bariatric toilet seat support apparatus 6 of the current invention can be adapted for use on any conventional toilet. Preferably, the widest dimension of the toilet with which the bariatric toilet seat apparatus 6 is to be used in conjunction with is determined. The distance 50 between support member braces 18 corresponds to this widest dimension of a toilet. Correspondingly, as distance 50 narrows, distance 52, which corresponds to the width of the seat support member 12, will narrow as well. It will be recognized by one skilled in the art that the dimensions of the frame 8 will vary with the particular toilet that the bariatric toilet seat support apparatus 6 is to be used in conjunction with. Accordingly, it is contemplated that the overall dimensions, i.e., height and width of the apparatus 6, may be varied according to the particular toilet that the bariatric toilet seat support apparatus 6 of the current invention is to be used in conjunction with. Further, the overall dimensions may be varied to accord with applicable regulatory requirements.

Referring now to FIGS. 1–6, it will be recognized by one of skill in the art that the bariatric toilet seat support apparatus 6 of the current invention is capable of supporting a toilet seat 4 such that when the toilet seat receives the weight of a user, the weight is distributed onto the frame 8 of the support apparatus 6 and the weight is relieved from the toilet bowl 14 of the toilet 2. It will be further appreciated by one of skill in the art that the addition of adjustable base members and adjustable wall locator members aid in positioning the seat support members 12 between the toilet seat 4 and the toilet bowl 14 such that the toilet seat rests in a substantially parallel manner on the top surfaces of the respective support members 12.

It should be further apparent to those skilled in the art that the bariatric toilet seat support apparatus of the current invention, as described herein, contains several features, and that variations to the preferred embodiment disclosed herein may be made which embody only some of the features disclosed herein. For example, it may be desirable to construct the apparatus having a frame of a different configuration but which ultimately achieves the object of relieving the weight from the toilet 2. Also, it may be desirable to construct a bariatric toilet seat support apparatus in accordance with the current invention without adjustable base members 36, or with base members 36 fixedly attached to the frame 8. Additionally, it may be desirable to construct a bariatric toilet seat support apparatus without adjustable wall locator members 26. Furthermore, it may be desirable to add bores in the toilet seat support apparatus to engage a locking mechanism, such as a lock and chain to secure the apparatus at a location. Even further, grab bars or other types of assistance features may be added to the apparatus for those individuals who need assistance in moving to and from a toilet, particularly when such structures are not present in the room where the toilet is located.

Various other combinations, and modifications or alternatives, may also be apparent to those skilled in the art. Such various alternatives and other embodiments are contemplated as being within the scope of the following claims, which particularly point out and distinctly claim the subject matter regarded as the invention.

We claim:

1. In combination, a bariatric toilet seat apparatus and a toilet;

the toilet comprising: a bowl having a top surface; and a conventional toilet seat fixedly attached to the toilet and capable of being raised or lowered onto the top surface of the bowl, the seat adapted to receive a portion of a body of a user;

the bariatric toilet seat apparatus comprising:

a weight distributing frame positionable on a floor surface; and a pair of toilet seat support members attached to the frame;

and wherein, the support members are located between the toilet bowl and the toilet seat such that when the toilet seat is lowered, the toilet seat rests on the support members to relieve the toilet bowl from supporting the user; and further wherein the apparatus is placed into position without the toilet seat being removed from the toilet such that a weight applied to the toilet seat is distributed through the frame to the floor surface and removed from the toilet.

2. The combination of claim 1, wherein the toilet is a wall-mounted toilet.

3. The combination of claim 1 wherein the toilet is a floor-mounted toilet.

4. The combination of claim 1, wherein the toilet seat is capable of being raised or lowered when the support apparatus is located between the toilet bowl and the toilet seat.

5. The combination of claim 1 wherein the support apparatus further comprises base members removably attached to the frame.

6. The combination of claim 5 wherein the base members comprise height adjustment members for the support apparatus.

7. The combination of claim 6 wherein each of the base members further comprises a floor member with a non-slip bottom surface for being placed on the floor surface, the floor member adapted to engage the height adjustment members of the support apparatus.

8. The combination of claim 6 wherein each of the base members further comprises a means for leveling, the means for leveling coupled to the floor members and engaging the height adjustment members, wherein the height adjustment members of the support apparatus are adjustable to position the seat support members at a location between the top surface of the toilet bowl and the toilet seat such that the top surface of the toilet bowl, the support members and the toilet seat are all located substantially parallel to one another.

9. The combination of claim 1 wherein the support apparatus further comprises a pair of adjustable wall locator members engageable with a wall proximate to the toilet, wherein said wall locator members are adjustable to position said seat support members at a proper location between the top surface of the toilet bowl and the toilet seat.

10. The combination of claim 9 wherein said adjustable wall locator members are removably attached to the weight distributing frame.

11. The combination of claim 1, wherein said toilet seat support members are of a thickness such that the toilet seat rests substantially along said support members and substantially parallel with the floor surface.

12. The combination of claim 1, wherein said toilet seat support members are parallelepiped.

13. The combination of claim 1, wherein the toilet seat support members comprise a top surface and a bottom surface and wherein the weight distributing frame is fixedly attached along outside edges of the bottom surface of the respective toilet seat support members.

* * * * *